US006237720B1

(12) United States Patent
Sutton

(10) Patent No.: US 6,237,720 B1
(45) Date of Patent: May 29, 2001

(54) ENGINE OIL PAN INCLUDING SEDIMENT BASIN AND BAFFLE CONFIGURATION

(76) Inventor: H. C. Sutton, 910 N. 33rd, Monroe, LA (US) 71201

( * ) Notice: Subject to any disclaimer, the term of this patent is extended or adjusted under 35 U.S.C. 154(b) by 0 days.

(21) Appl. No.: 09/334,762

(22) Filed: Jun. 16, 1999

(51) Int. Cl.[7] ..... F01M 11/03

(52) U.S. Cl. ..... 184/106; 123/195 C; 210/532.1

(58) Field of Search ..... 184/106, 6.24; 123/195 C, 196 A; 210/532.1, 521, 533

(56) References Cited

U.S. PATENT DOCUMENTS

| | | | | |
|---|---|---|---|---|
| 1,623,728 | * | 4/1927 | Hooton | 184/6.24 X |
| 1,729,978 | | 10/1929 | Barron | 184/106 X |
| 1,761,930 | * | 6/1930 | McCuen | 184/6.24 X |
| 1,802,847 | * | 4/1931 | Stolte | 210/532.1 X |
| 1,892,185 | * | 12/1932 | Clements | 210/532.1 X |
| 2,577,188 | * | 12/1951 | Hall | 184/106 |
| 2,649,204 | * | 8/1953 | Brier, Jr. | 210/533 X |
| 2,837,075 | | 6/1958 | Leach | 123/195 C |
| 3,165,468 | * | 1/1965 | Strader | 210/532.1 X |
| 4,296,716 | | 10/1981 | Hofbauer et al. | 123/195 C |
| 4,770,276 | | 9/1988 | Takubo | 184/106 |
| 5,058,545 | | 10/1991 | Hirai et al. | 123/195 C |
| 5,465,692 | | 11/1995 | Uraki et al. | 123/195 C |
| 5,601,060 | | 2/1997 | Smietanski et al. | 123/195 C |
| 5,653,205 | | 8/1997 | Ozeki | 123/195 C |

* cited by examiner

*Primary Examiner*—Charles A. Marmor
*Assistant Examiner*—Ankur Parekh
(74) *Attorney, Agent, or Firm*—John M. Harrison

(57) ABSTRACT

A sediment basin and baffle combination for internal combustion engines, which combination includes a sediment basin in the bottom of the engine oil pan for accumulating sediment and contaminants from the engine oil and a baffle positioned over the sediment basin for limiting re-entry of the accumulated sediment back into the oil reservoir from the sediment basin. In a preferred embodiment the baffle includes a baffle grid constructed from one or more layers of elongated baffle elements, each having a triangular-shaped cross-section. Each baffle element is oriented in the baffle grid with a triangle apex of each baffle element facing upwardly to promote drainage of sediment and contaminant deposits through the grid, into the sediment basin and a triangle base of each baffle element facing downwardly toward the sediment basin to retard sediment and contaminant re-entry into the oil. In one embodiment the elements of one of the grid layers are disposed in perpendicular relationship with respect to the elements of the adjacent grid layer or layers, and in another embodiment the single-layered grid is characterized by multiple, intersecting longitudinal and transverse baffle elements provided in a single plane. In still another embodiment the baffle is characterized by a baffle grate having at least one layer and preferably, two layers of parallel baffle elements, and the baffle elements of one layer are staggered or offset and parallel with respect to the elements of the adjacent layer or layers. In a most preferred embodiment the sediment basin and baffle combination includes a baffle ring that overhangs the sediment basin and, with the baffle, retards sloshing of the basin sediment back through the baffle, into the oil reservoir in the pan.

6 Claims, 3 Drawing Sheets

20
17
17
17
19
16
22
1
3
3
5
5
2
14
14
12
13
11
18

6
7
3

6
7
3

ENGINE OIL PAN INCLUDING SEDIMENT BASIN AND BAFFLE CONFIGURATION

BACKGROUND OF THE INVENTION

1. Field of the Invention

This invention relates to the oil reservoirs or pans of internal combustion engines and more specifically, to a sediment basin and baffle combination for internal combustion engines, which combination includes a sediment basin shaped in the bottom of the engine oil pan and into which sediment and contaminants settle from the engine oil, and a baffle positioned over the sediment basin to retard re-entry of the settled sediment and contaminants back into the oil reservoir from the sediment basin. In a preferred embodiment the baffle is characterized by a baffle grid constructed of at least one horizontal layer of elongated, parallel baffle elements, each having a triangularly-shaped cross-section, with a base of each baffle element facing the sediment basin and an apex facing the oil reservoir. In one embodiment the baffle elements of each layer of the grid are arranged in perpendicular relationship to the baffle elements of the adjacent layer or layers, and in another embodiment the single-layered grid is characterized by multiple, intersecting longitudinal and transverse baffle elements provided in perpendicular relationship to each other in a single plane. In still another embodiment the baffle elements are arranged in parallel relationship in at least one layer to define a grate, and the baffle elements of each layer of the multi-layered grate are staggered or offset and parallel with respect to the baffle elements of the adjacent, underlying or overlying layer. In a most preferred embodiment of the invention the sediment basin is fitted with a baffle flange or ring which, in combination with the baffle, retards re-entry of the sediment in the basin from splashing back into the oil reservoir in the oil pan. A sloping oil pan bottom is also preferred to aid migration of sediment into the basin.

One of the conditions which contributes to reduced service life of an internal combustion engine is the accumulation of sediment and contaminants such as sludge, muck, dirt, metal particles, water and other material that accumulates in the oil reservoir in the engine oil pan. This sediment is continuously mixed with the oil in the oil pan and is picked up by the oil pump and pumped into the oil filter, where much of it is accumulated. However, some of the sediment is pumped through the oil filter and then through the engine, where it has an adverse effect on the lubricated engine parts, including the pistons, piston rings and other crucial operating parts. Some of the sediment is also burned by the engine and contributes to pollution of the surrounding atmosphere.

2. Description of the Prior Art

Various devices for facilitating ease of draining oil from the crankcase of internal combustion engines and collecting oil contaminants, are known in the art. An early moisture trap for engines is detailed in U.S. Pat. No. 1,729,978, dated Oct. 1, 1929, to E. T. Barron. The Barron device includes a trap provided in the oil pan and a slotted bolt vertically oriented in the trap and extending into the oil pan, such that sediment accumulating in the trap can be selectively drained from the trap without the necessity of draining the oil pan. U.S. Pat. No. 2,837,075, dated Jun. 3, 1958, to C. B. Leach details an engine crankcase and slanted oil pan structure which is conducive to easy drainage of oil from the oil pan. An engine having a divided oil pan is detailed in U.S. Pat. No. 4,296,716, dated Oct. 27, 1981, to Hofbauer, et al. The oil pan includes a waffled depression at the bottom thereof.

U.S. Pat. No. 4,770,276, dated Sep. 13, 1988, to Takubo, details an oil pan having a depression in the bottom thereof for accommodating an oil strainer or filter. U.S. Pat. No. 5,058,545, dated Oct. 22, 1991, to Harai et al, details an internal combustion engine oil pan having an inclined bottom and a sump. The design promotes recirculation of crankcase oil through the engine. A multi-shell oil pan is detailed in U.S. Pat. No. 5,465,692, dated Nov. 14, 1995, to Uraki et al. A baffle plate is provided in the upper portion of the oil pan to prevent splashing of oil in the oil pan. U.S. Pat. No. 5,601,060 details a cast oil pan having a depressed sump area to create a drain passage beneath the suction passage of the oil pump. Another engine oil pan is detailed in U.S. Pat. No. 5,653,205, dated Aug. 5, 1997, which oil pan includes a partition for regulating transverse oil movement and baffle plates for controlling vertical oil movement in the pan.

It is an object of this invention to provide a combination sediment basin and baffle for trapping and removing internal combustion engine contaminants, residue and sediment from the oil pan or reservoir of the engine.

Another object of the invention is to provide a sediment basin and baffle for application to the bottom of an internal combustion engine oil pan, which sediment basin is located at the bottom-most point in the oil pan for accumulating sediment and contaminants from the engine oil and the baffle is constructed of at least one layer of elongated baffle elements, each having a triangular-shaped cross-section, with the apexes of the baffle elements facing upwardly and the bases facing downwardly to facilitate drainage of sediment and residue from the engine oil and into the sediment basin and retard re-entry of the sediment and residue from the basin into the oil reservoir.

Still another object of the invention is to provide a combination sediment basin and baffle for the oil pan of an internal combustion engine, which combination includes a sediment basin fitted with a drain plug and a flange or rim at the top thereof and into which sediment and contaminants settle from the engine oil and a baffle grate constructed of at least one layer of elongated, parallel baffle elements, each having a triangular-shaped cross-section. The baffle elements of each layer are each arranged with a triangle apex facing upwardly to promote drainage of residue, sediment and contaminants from the oil reservoir into the sediment basin, and a base opposite the apex facing downwardly toward the sediment basin, to retard re-entry of the residue, contaminants and sediment into the oil reservoir from the sediment basin by reverse-flow through the baffle, and the baffle elements of one layer are arranged in offset or staggered and parallel relationship to the baffle elements of the adjacent, underlying or overlying layer.

Another object of this invention is to provide a sediment basin and baffle for mounting in oil pans, which sediment basin includes a depression shaped in the bottom of the oil pan and the baffle is characterized by a baffle grid extending over the depression and attached to a flange or ring surrounding the depression, which baffle grid includes at least two layers of multiple, elongated baffle elements, each having a triangular-shaped cross-section, with an apex facing upwardly for promoting entry of the sediment from the oil reservoir into the basin and a base facing downwardly for retarding re-entry of the sediment from the basin into the oil reservoir, and the baffle elements of one layer are arranged in perpendicular relationship to the baffle elements of the adjacent, underlying or overlying layer.

A still further object of this invention is to provide a sediment basin and baffle for mounting in engine oil pans and facilitating removal of sediment and contaminants from the engine oil while limiting re-entry of the removed sediment and contaminants into the oil reservoir, which sediment basin and baffle includes a baffle grid characterized by multiple, intersecting longitudinal and transverse baffle elements provided in perpendicular relationship to each other in a single plane in the baffle grid.

SUMMARY OF THE INVENTION

These and other objects of the invention are provided in a sediment basin and baffle combination for trapping and retaining sludge, residue, sediment and like contaminants in the oil pan of an internal combustion engine. The sediment basin is characterized by a basin or depression formed in the bottom-most area of the oil pan and typically receiving the oil pan drain plug. The baffle includes multiple, elongated baffle elements, each having a triangular cross-section and arranged in a grid or grate in one or more planes or layers. The baffle elements in each layer of the baffle are oriented with the apexes of the baffle elements facing upwardly, toward the oil reservoir to promote drainage of sediment and residue from the engine oil and into the sediment basin and the bases of the baffle elements facing downwardly, toward the sediment basin to retard re-entry of the sediment and residue from the basin into the oil reservoir. In the baffle grate embodiment, the parallel baffle elements of one layer are offset or staggered and parallel with respect to the elements of the adjacent layer, and in the multi-layered baffle grid embodiment the parallel baffle elements of one layer are disposed in perpendicular relationship to the parallel elements of the adjacent, overlying or underlying layer. In the single-layered baffle grid embodiment, multiple longitudinal and transverse baffle elements are provided in perpendicular and intersecting relationship to each other in a single plane in the baffle grid. The sediment basin most preferably includes a flange or ring extending around the periphery or perimeter thereof and mounting the baffle. The sediment basin and baffle combination is preferably mounted in an oil pan base which has a sloped orientation for draining the contaminants into the sediment basin.

BRIEF DESCRIPTION OF THE DRAWINGS

The invention will be better understood by reference to the accompanying drawings, wherein.

DESCRIPTION OF THE PREFERRED EMBODIMENTS

Figures 1, 10, 11:
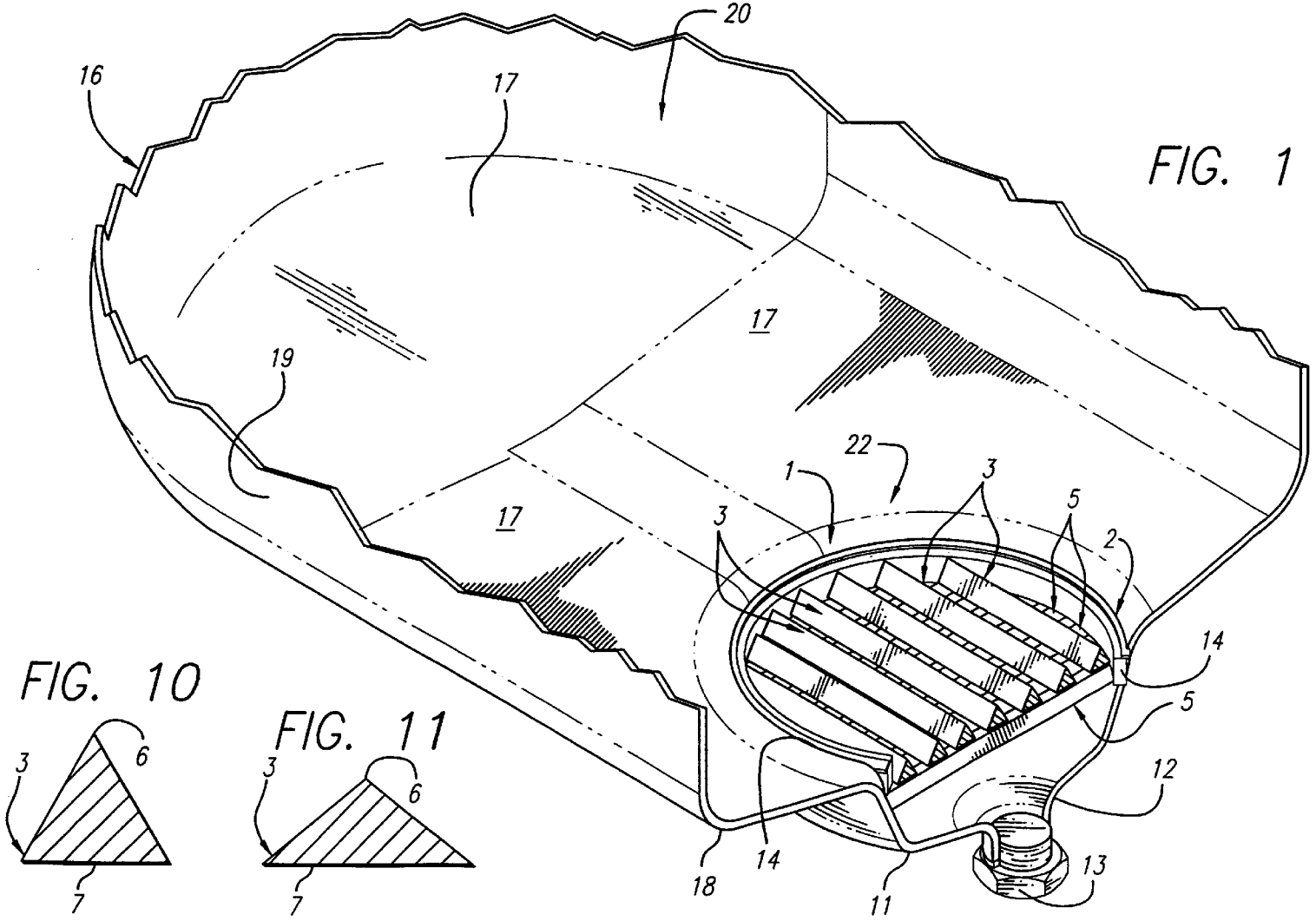
FIG. 1 is a perspective view, partially in section, of an internal combustion engine oil pan fitted with the sediment basin and baffle combination of this invention, and a bi-layered baffle grid embodiment of the sediment basin and baffle combination, provided in the oil pan.
FIG. 10 is a cross-sectional view of a baffle element component of a preferred embodiment of the sediment basin and baffle combination, which baffle element has the typical cross-sectional configuration of an equilateral triangle.
FIG. 11 illustrates an alternative cross-sectional configuration of the baffle element, which baffle element has the typical cross-sectional configuration of an isosceles triangle.

Referring initially to FIGS. 1–3 and 8–11 of the drawings, in a preferred embodiment the sediment basin and baffle combination of this invention is generally illustrated by reference numeral 22. The sediment basin and baffle combination 22 is designed to trap, accumulate or remove sediment and contaminants such as sludge, muck, dirt, metal particles, water and other impurities from engine oil (not illustrated) contained in the interior oil reservoir 20 of an engine oil pan 16, attached to an internal combustion engine (not illustrated), and retard re-entry of the removed sediment and contaminants back into the oil reservoir 20, as hereinafter further described. The oil pan 16 is removably attached to the internal combustion engine (not illustrated) in conventional fashion, and typically includes a sloped pan floor 17 which is disposed at an obtuse pan floor angle 18 with respect to the vertical pan sides 19 of the oil pan 16 and causes the engine oil (not illustrated) contained in the oil reservoir 20 of the oil pan 16 to normally settle in the bottom of the oil pan 16. The sediment basin and baffle combination 22 of this invention includes a sediment basin 11, shaped in the bottom-most point in the pan floor 17 of the oil pan 16, and the bottom of the sediment basin 11 tapers downwardly to define a substantially cylindrical drain 12, removably sealed by means of a drain plug 13, as hereinafter further described.

Figure 2:
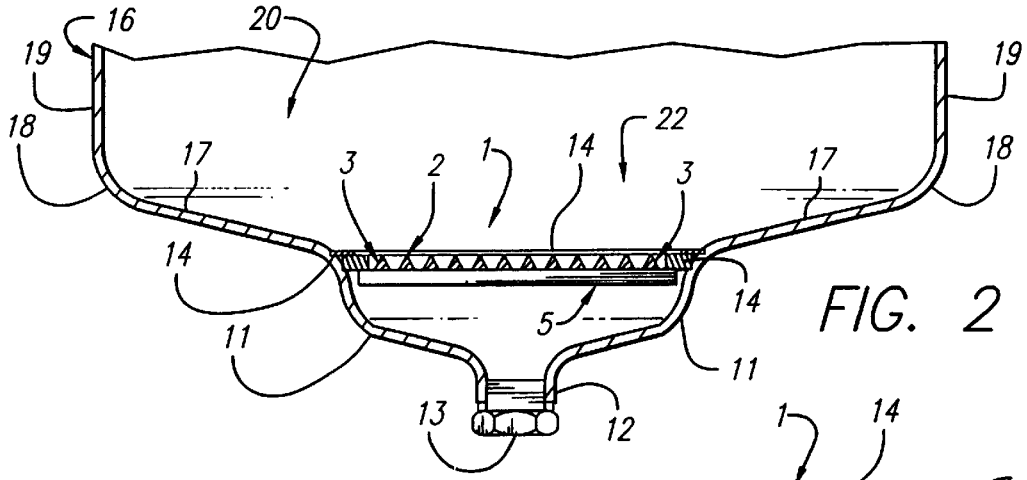
FIG. 2 is a transverse sectional view of the oil pan and the sediment basin and baffle combination illustrated in FIG. 1.
Figure 3:
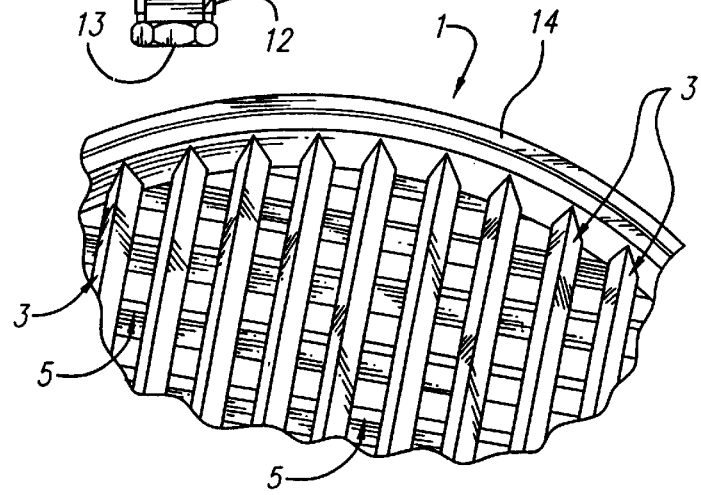
FIG. 3 is an enlarged perspective view, partially in section, of the sediment basin and baffle combination illustrated in FIGS. 1 and 2.

As illustrated in FIGS. 1 and 2, the sediment basin and baffle combination 22 further includes a baffle 1, provided between the oil reservoir 20 and the sediment basin 11, which baffle 1 promotes flow of contaminants and sediment from the engine oil contained in the oil reservoir 20, into the sediment basin 11 while retarding re-entry of the contaminants and sediment from the sediment basin 11 back into the oil reservoir 20, as hereinafter described. In a first embodiment of the sediment basin and baffle combination 22 illustrated in FIGS. 1–3, the baffle 1 is characterized by a baffle grid 2, constructed from a layer of multiple, elongated, parallel top baffle elements 3, and a layer of similar bottom baffle elements 5, provided in substantially perpendicular relationship to the top baffle elements 3, as particularly illustrated in FIG. 3. Each of the top baffle elements 3 and bottom baffle elements 5 is constructed from a heat-resistant metal, typically stainless steel and has a transverse cross-sectional configuration typically shaped like an equilateral triangle as illustrated in FIG. 10, an isosceles triangle as illustrated in FIG. 11 or a scalene triangle (not illustrated). As further illustrated in FIGS. 10 and 11, each of the triangular top baffle elements 3 and bottom baffle elements 5 is characterized by an element apex 6 and an element base 7, located opposite the element apex 6. The top baffle elements 3 are oriented in the baffle grid 2 with the tapered element apexes 6 facing upwardly toward the oil reservoir 20 of the oil pan 16, and the flat element bases 7 of the top baffle elements 3 facing the sediment basin 11. The bottom baffle elements 5 are similarly oriented in the baffle grid 2, and the upwardly-facing element apex 6 of each bottom baffle element 5 is typically spot-welded to the downwardly-facing element base 7 of each top baffle element 3 to secure the top baffle elements 3 and bottom baffle elements 5 in perpendicular relationship in the baffle grid 2. It will be appreciated by those skilled in the art that the orientation of the element apex 6 and element base 7 of each top baffle element 3 and bottom baffle element 5 in the baffle grid 2 promotes drainage of sediment and contaminant deposits from the oil reservoir 20 through the baffle grid 2, into the sediment basin 11, and also retards sediment and contaminant re-entry from the sediment basin 11 back into the oil reservoir 20, as hereinafter further described.

Figure 8:
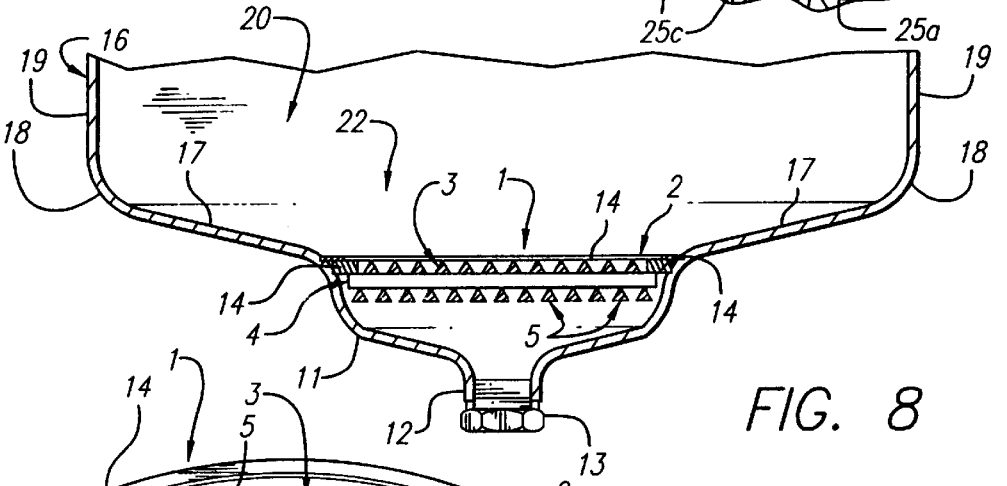
FIG. 8 is a transverse sectional view of a multi-layered baffle grid embodiment of the sediment basin and baffle combination.
Figure 9:
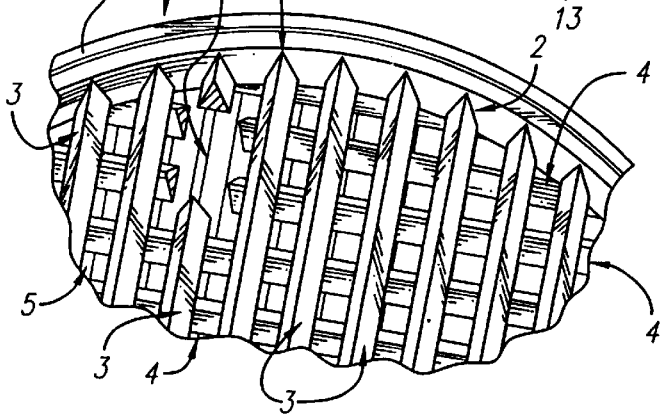
FIG. 9 is an enlarged perspective view, partially in section, of the sediment basin and baffle combination illustrated in FIG. 8.

In a most preferred embodiment of the invention illustrated in FIGS. 8 and 9, the baffle grid 2 of the baffle 1 is constructed from a layer of top baffle elements 3, a layer of bottom baffle elements 5 and a layer of middle baffle elements 4, which are similar in construction to the top baffle elements 3 and bottom baffle elements 5, with the baffle elements of each layer provided in substantially perpendicular relationship with respect to the baffle elements of the adjacent, overlying or underlying layer as illustrated in FIG. 9. The element apexes 6 of the middle baffle elements 4 are typically spot-welded to the element bases 7 of the respective top baffle elements 3, and the element apexes 6 of the bottom baffle elements 5 may be spot welded to the element bases 7 of the respective middle baffle elements 4. In both embodiments illustrated in FIGS. 1–3 and FIGS. 8 and 9, respectively, a baffle ring 14 typically circumscribes the top baffle elements 3 of the baffle grid 2, and is welded to the pan floor 17 of the oil pan 16, above the sediment basin 11 to secure the baffle grid 2 to the oil pan 16, between the oil reservoir 20 and the sediment basin 11.

Referring again to FIGS. 1–3, 8 and 9 of the drawings, in typical application of the sediment basin and baffle combination 22 of this invention the oil pan 16 is typically bolted to the internal combustion engine (not illustrated) in conventional fashion and the oil reservoir 20 of the oil pan 16 filled with engine oil, in conventional fashion. Because of the sloped pan floor 17 of the oil pan 16 defined by the obtuse pan floor angle 18, the engine oil settles in the sediment basin 11 and oil reservoir 20 of the oil pan 16. During operation of the internal combustion engine, as the conventional oil pump (not illustrated) pumps oil from the oil reservoir 20 and supplies the oil to the operating parts of the engine, the oil lubricates the engine and then flows back into the oil reservoir 20, where the oil is again circulated through the oil pump to continually lubricate the engine. The circulating oil picks up sludge, muck, dirt, metal particles, water and other impurities from the engine, and most of the impurities are normally filtered by the oil filter downstream of the oil pump. However, in the oil pans of conventional engines, a significant quantity of the impurities flows through the oil filter and is re-circulated to the engine, where the impurities have an adverse effect on the lubricated engine parts, including the pistons and piston rings. In application of the sediment basin and baffle combination 22, the impurities which are circulated with the oil from the engine back to the oil reservoir 20, settle by gravity through the baffle grid 2, where the upwardly-facing element apex 6 of each top baffle element 3 and bottom baffle element 5 (FIGS. 1–3) or top baffle element 3, middle baffle element 4 and bottom baffle element 5 (FIGS. 8 and 9), facilitates ready passage of the impurities from the oil reservoir 20, through the openings between the top baffle elements 3, middle baffle elements 4 and bottom baffle elements 5 of the baffle grid 2 and into the sediment basin 11, where the impurities accumulate. Conversely, the flat element bases 7 of the top baffle elements 3, middle baffle elements 4 and bottom baffle elements 5 collectively present a surface which retards sloshing of the settled sediments and impurities from the sediment basin 11, back through the baffle grid 2 and into the oil reservoir 20. When it becomes necessary to change the engine oil in the oil reservoir 20, the drain plug 13 is removed from the drain 12, the engine oil and accumulated sediments allowed to drain from the sediment basin 11 and oil reservoir 20 through the drain 12, the drain plug 13 again inserted in the drain 12 and the oil reservoir 20 filled with engine oil, in conventional fashion.

Figure 6:
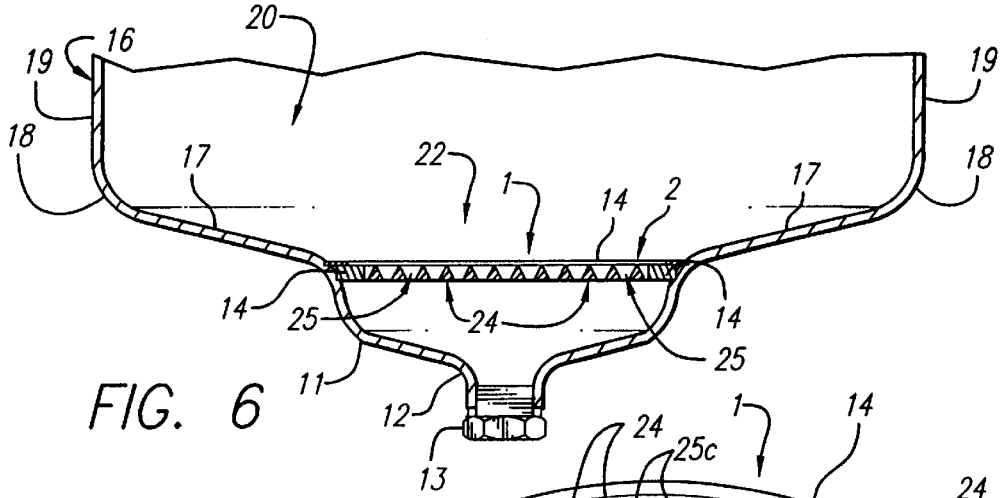
FIG. 6 is a transverse sectional view of a single-layered baffle grid embodiment of the sediment basin and baffle combination.
Figure 7:
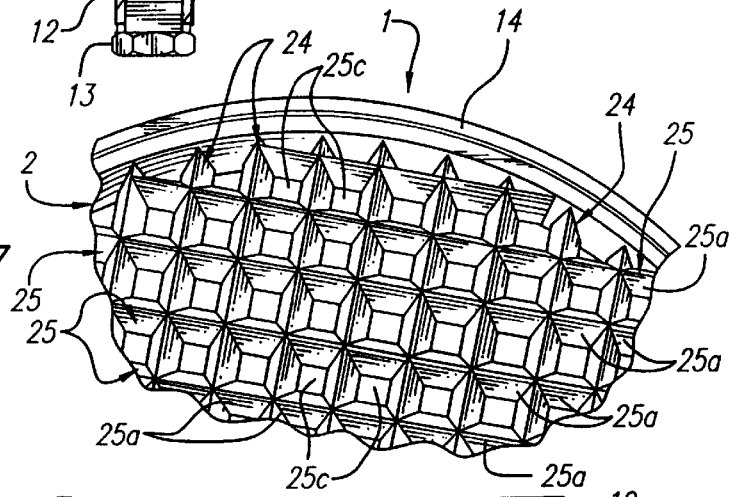
FIG. 7 is an enlarged perspective view, partially in section, of the sediment basin and baffle combination illustrated in FIG. 6.

Referring next to FIGS. 6 and 7 of the drawings, in another embodiment of the sediment basin and baffle combination 22, the baffle grid 2 of the baffle 1 is characterized by multiple, parallel, longitudinal baffle elements 24 and multiple transverse baffle element segments 25*a* of the transverse baffle elements 25, which baffle element segments 25*a* span the adjacent longitudinal baffle elements 24 in the baffle grid 2, in substantially perpendicular and coplanar relationship with respect to the longitudinal baffle elements 24. The baffle grid 2 can be constructed using conventional molding techniques or alternatively, each of the transverse baffle element segments 25*a* may be typically welded to the adjacent longitudinal baffle elements 24, to secure the transverse baffle element segments 25*a* and the longitudinal baffle elements 24 in substantially coplanar relationship with respect to each other in the baffle grid 2. As illustrated in FIG. 7, each row of aligned transverse baffle element segments 25*a* defines an elongated transverse baffle element 25 which intersects the perpendicular longitudinal baffle elements 24 to define the respective grid drain openings 25*c*. Each typically stainless steel, longitudinal baffle element 24 and transverse baffle element segment 25*a* has a triangular cross-sectional configuration as illustrated in FIGS. 10 and 11 and described above with respect to the embodiments illustrated in FIGS. 1–3 and FIGS. 8 and 9. Moreover, each longitudinal baffle element 24 and transverse baffle element segment 25*a* is oriented in the baffle grid 2 with the element apex 6 facing upwardly toward the oil reservoir 20 in the oil pan 16 to promote drainage of sediment deposits through the baffle grid 2, into the sediment basin 11 and the element base 7 of each longitudinal baffle element 24 and transverse baffle element segment 25*a* facing downwardly toward the sediment basin 11 to retard sediment re-entry into the oil, as heretofore described.

Figure 4:
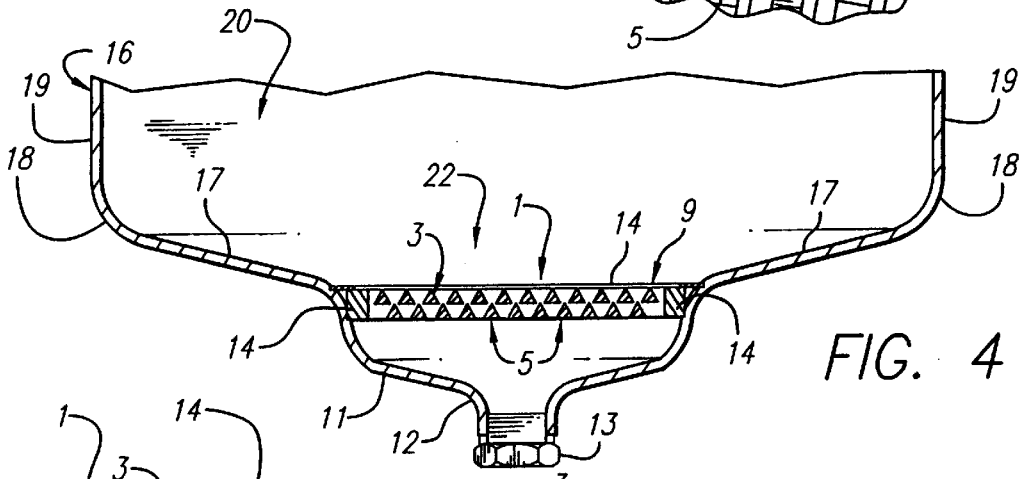
FIG. 4 is a transverse sectional view of the oil pan and a bi-layered baffle grate embodiment of the sediment basin and baffle combination, provided in the oil pan.
Figure 5:
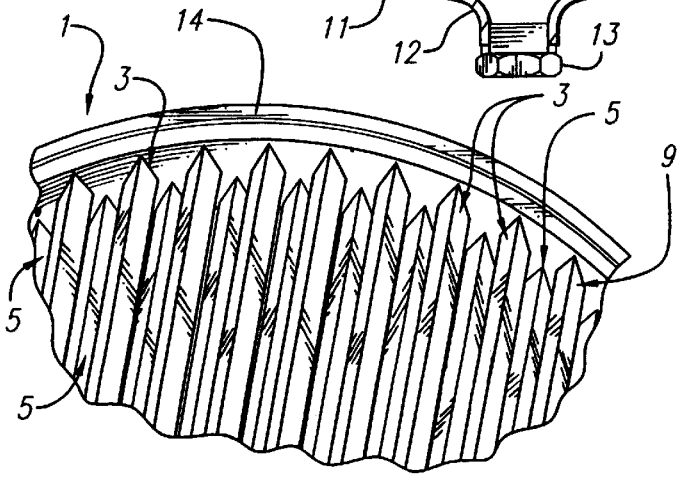
FIG. 5 is an enlarged perspective view, partially in section, of the sediment basin and baffle combination illustrated in FIG. 4.

Referring next to FIGS. 4 and 5 of the drawings, in another embodiment of the sediment basin and baffle combination 22 the baffle 1 is characterized by a baffle grate 9, including a layer of multiple, parallel top baffle elements 3 and a layer of parallel bottom baffle elements 5. Each of the bottom baffle elements 5 is positioned in staggered or offset relationship with respect to the top baffle elements 3, with the element apex 6 of each bottom baffle element 5 positioned between the element bases 7 of adjacent top baffle elements 3, as illustrated in FIG. 4. The element apex 6 of each bottom baffle element 5 is typically spot-welded at selected points to the adjacent top baffle elements 3 along the sides of the top baffle elements 3, and the outermost top baffle elements 3 and bottom baffle elements 5 are typically circumscribed by a baffle ring 14, typically welded to the top baffle elements 3 and/or the bottom baffle elements 5 of the baffle grate 9 and the pan floor 17 of the oil pan 16, above the sediment basin 11. As heretofore described, each top baffle element 3 and bottom baffle element 5 is oriented in the baffle grate 9 with each element apex 6 facing upwardly toward the oil reservoir 20, and each element base 7 facing downwardly toward the sediment basin 11 to facilitate passage of the sediment and impurities from the oil reservoir 20 to the sediment basin 11, between the top baffle elements 3 and bottom baffle elements 5.

It will be appreciated by those skilled in the art that the triangular cross-sectional configuration of the baffle elements of the sediment basin and baffle combination 22 of this invention promotes downward settlement of sediment, oil contaminants and impurities from the oil reservoir 20, through the baffle 1 and into the sediment basin 11, and hinders or retards upward flow of the sediment, contaminants and impurities from the sediment basin 11 back into the oil reservoir 20. It is understood that the various baffle elements described above with respect to FIGS. 1–9 can be constructed from any heat and corrosion-resistant metal including stainless steel with stainless steel being the preferred material of construction. Furthermore, the baffle grid 2 described above with respect to FIGS. 1, 2, 4 and 5, as well as the baffle grate 9 described above with respect to FIG. 3, can be constructed from conventional molding techniques, as well as by welding together the baffle 1 components as heretofore described. While the baffle elements can be constructed in virtually any triangular cross-sectional configuration, including that of an equilateral triangle as illustrated in FIG. 6, an isosceles triangle as illustrated in FIG. 7 or a scalene triangle (not illustrated), due to manufacturing considerations the preferred cross-sectional configuration of the baffle elements is that of an equilateral triangle. Moreover, while multiple layers of baffle elements in the baffle 1 are preferred, it is understood that a single layer of baffle elements is sufficient for achieving the separating purpose of the baffle 1. Under normal conditions this baffle device will never require any replacement of parts or service. Each time the oil is changed, the accumulated sediment is flushed out.

While the preferred embodiments of the invention have been described above, it will be recognized and understood that various modifications in the invention can be made and the appended claims are intended to cover all such modifications which may fall within the spirit and scope of the invention.

Having described my invention with the particularity described above, what is claimed is:

1. An engine oil pan including a sediment basin and baffle combination, said combination designed for separating sediment from an oil reservoir in the engine oil pan, said sediment basin and baffle combination comprising a sediment basin provided in the bottom of the oil pan and at least one baffle element provided in the oil pan between the oil reservoir and said sediment basin, said baffle element characterized by a triangular cross-sectional configuration, with a triangle base of said baffle element facing said sediment basin and a triangle apex of said baffle element facing the oil reservoir, said baffle element for receiving the sediment into the sediment basin and retarding re-entry of the sediment from the sediment basin into the oil reservoir.

2. The sediment basin and baffle combination of claim 1 wherein said at least one baffle element comprises a plurality of baffle elements.

3. The sediment basin and baffle combination of claim 2 wherein said at least one baffle element comprises a plurality of baffle elements oriented to define a baffle grate.

4. The sediment basin and baffle combination of claim 1 comprising a baffle ring attached to the oil pan and wherein said at least one baffle element is supported by said baffle ring.

5. The sediment basin and baffle combination of claim 4 wherein said at least one baffle element comprises a plurality of baffle elements.

6. An engine oil pan including a sediment basin and baffle combination for separating sediment from an oil reservoir in the engine oil pan, said sediment basin and baffle combination comprising a sediment basin provided in the bottom of the oil pan, a drain plug provided in the sediment basin, and a baffle provided in the oil pan between the oil reservoir and said sediment basin, said baffle comprising a baffle ring secured to the oil pan and a baffle grate supported by said baffle ring, said baffle grate including a plurality of first baffle elements spanning said baffle ring and a plurality of second baffle elements provided in said baffle grate beneath and in substantially parallel relationship to said first baffle elements, said second baffle elements positioned in substantially offset relationship to said first baffle elements and each of said first baffle elements and said second baffle elements having a substantially triangular cross-sectional configuration, with a triangle base of said baffle elements facing said sediment basin and a triangle apex of said baffle elements facing the oil reservoir.

* * * * *